United States Patent [19]

Malacheski

[11] 4,109,668

[45] Aug. 29, 1978

[54] COIN COUNTER

[76] Inventor: Joseph J. Malacheski, 130 E. Division St., Wilkes-Barre, Pa. 18702

[21] Appl. No.: 800,652

[22] Filed: May 26, 1977

Related U.S. Application Data

[63] Continuation of Ser. No. 639,360, Dec. 10, 1975, abandoned.

[51] Int. Cl.[2] ..... G07D 9/02

[52] U.S. Cl. ..... 133/8 R; 211/49 R

[58] Field of Search ..... 133/1 A, 8 R, 8 A, 8 B, 133/8 D; 206/0.83, 0.84; D87/3 D; 211/49 R

[56] References Cited

U.S. PATENT DOCUMENTS

| | | | |
|---|---|---|---|
| 793,779 | 7/1905 | Fisher | 211/49 R X |
| 2,504,975 | 7/1952 | Nielsen et al. | 206/0.83 |
| 3,107,467 | 10/1963 | Gazes | 133/8 R X |
| 3,606,008 | 9/1971 | Lusetti | 206/0.84 |
| 3,736,947 | 6/1973 | Gdanski | 133/8 R |

FOREIGN PATENT DOCUMENTS

| | | | |
|---|---|---|---|
| 1,476,744 | 3/1967 | France | 133/8 R |

*Primary Examiner*—Robert B. Reeves
*Assistant Examiner*—Fred A. Silverberg
*Attorney, Agent, or Firm*—Robert K. Youtie

[57] ABSTRACT

For counting coins to predetermined quantities and packing the same in wrappers, there is provided an elongate fluted or grooved body, the flutes or grooves each being closed at one end and open at another end, having indicia denoting a selected predetermined quantity of coins received in each groove, and providing for the feeding of a quantity of coins from each groove to a receiving wrapper.

4 Claims, 5 Drawing Figures

COIN COUNTER

CROSS REFERENCES TO RELATED APPLICATIONS

This application is a continuation of application Ser. No. 639,360 filed December 10, 1975, now abandoned.

BACKGROUND OF THE INVENTION

As is well known to those versed in the art, there have, in the past, been provided devices to facilitate the counting of coins and wrapping the same. However, such prior devices were relatively complex in design, being subject to malfunction in operation, often lacking versatility for use with different coin sizes, and were relatively expensive to manufacture while requiring considerable space in both use and nonuse.

SUMMARY OF THE INVENTION

It is, therefore, an important object of the present invention to provide a coin counting device which overcomes the above-mentioned difficulties, is extremely simple in construction, having no moving parts, for indefinite durability and use without malfunction, is relatively inexpensive to maufacture as being small and requiring a minimum of materials, and is highly versatile in use for counting and wrapping coins of various denominations.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

DESCRIPTION OF THE PREFERRED EMBODIMENT

Figures 1, 2, 3, 4, 5:
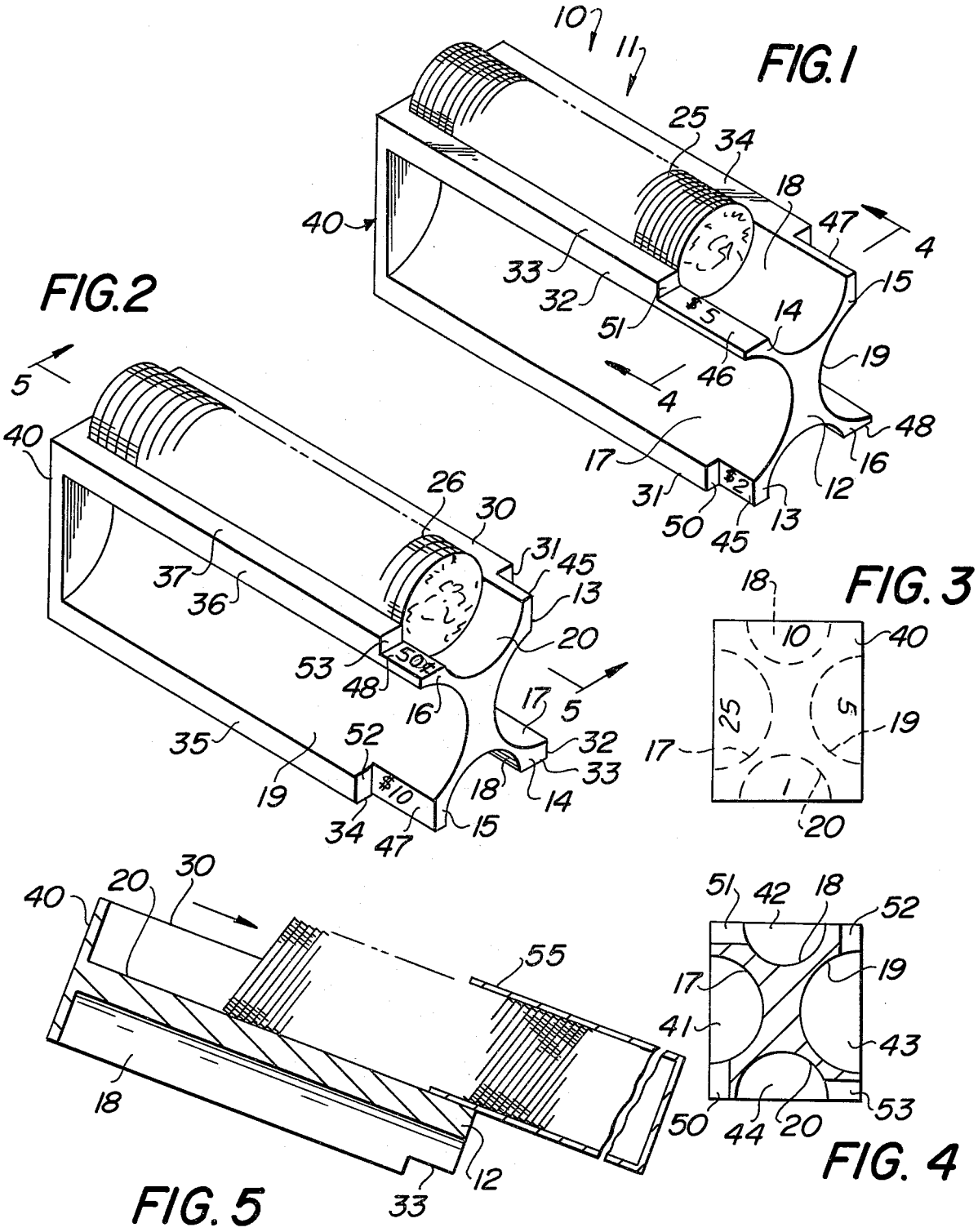
FIG. 1 is a perspective view showing a coin counting and wrapping device of the present invention illustrating formations for counting dimes and nickels.
FIG. 2 is a perspective view showing the device of FIG. 1, but illustrating the other side thereof whereon are formations for counting pennies and quarters.
FIG. 3 is an end view, as from the left-hand end of FIGS. 1 and 2.
FIG. 4 is a sectional view taken generally along the line 4—4 of FIG. 1.
FIG. 5 is a longitudinal sectional view taken generally along the line 5—5 of FIG. 2, but illustrating a wrapping operation.

Referring now more particularly to the drawings, and specifically to FIG. 1 thereof, a coin counting device is there generally designated 10, and may advantageously be fabricated of a single integral body 11 fabricated of suitable material, such as plastic, metal or the like, as desired. The body 11 may be generally elongate, including a longitudinally extending central member or spine part 12. Extending longitudinally along and projecting radially outwardly from the longitudinal central part or spine 12, at angularly spaced locations, are a plurality of fins, ridges or ribs 13, 14, 15 and 16. While there are illustrated herein a specific number of ridges or ribs 13–16, it is appreciated that a different number may be employed, more or less, as desired. As the ribs 13–16 of the illustrated embodiment are four in number, they are angularly spaced apart approximately 90°. Further, the space between each adjacent pair of ridges or ribs 13–16 provides a longitudinal recess or groove, a longitudinal recess or groove 17 being provided between the ribs 13 and 14, while a recess or groove 18 is provided between the ribs 14 and 15, a recess or groove 19 being located between the ribs 15 and 16, and a recess or groove 20 being formed between the ribs 16 and 13.

While the ribs 13–16 are all parallel to each other, as are the interrib recesses or grooves 17–20 parallel with each other and with the ribs, the ribs and grooves are all of different cross-sectional configuration. More specifically, the grooves are all of generally semicylindrical formation or semicircular cross-sectional configuration, but of different radii of curvature. For example, the groove 18 may be of smallest size or radius of curvature, being slightly greater than that of a dime for conformably receiving a stack of dimes 25. The groove 20 may be of next largest radius of curvature, slightly greater than that of a penny for conformably receiving a stack of pennies 26. Similarly, the groove 19 may be of next largest radius of cross-sectional curvature, slightly larger than that of a nickel for conformably receiving a stack of nickels, while the groove 19 is of largest cross-sectional radius of curvature, slightly larger than that of a quarter for conformably receiving a stack of quarters.

Further, each of the ribs 13–16 is provided with a pair of outer surfaces at right angles to each other and each generally coplanar with an outer surface of the next adjacent rib. More specifically, rib 13 includes, at right angles to each other, longitudinally extending outer surfaces 30 and 31, while rib 14 is similarly bounded by a pair of outer surfaces at right angles to each other being surfaces 32 and 33. Rib 15 is also bounded by a pair of longitudinally extending right angulately disposed outer surfaces 34 and 35, while rib 16 is formed with right angularly disposed outer surfaces 36 and 37. Each adjacent pair of the outer rib surfaces on opposite sides of a groove 17, 18, 19, 20 are generally coplanar with each other. That is, surfaces 37 and 30 on opposite sides of groove 20 are coplanar, surfaces 31 and 32 on opposite sides of groove 18 being coplanar and surfaces 35 and 36 on opposite sides of groove 19 being coplanar. Thus, the body 11 is adapted to rest stably on any pair of coplanar surfaces noted above.

At one end the body 11 is provided with an end or closure wall generally designated 40, which may be considered as consisting of several coplanar, generally semicircular end members 41, 42, 43 and 44, respectively closing one end of each groove 17, 18, 19 and 20. This is best seen in FIG. 4. The other end of each groove remains open, for a purpose appearing presently.

Each rib 13, 14, 15 and 16 is cut away, adjacent to a respective groove 17, 18, 19 and 20, as at 45, 46, 47 and 48, respectively. That is, the rib 13 is cut away to define the recess or cutout 45 which opens laterally inwardly into adjacent grooves 17 and laterally outwardly through rib wall 30. Further, the cutout 45 opens longitudinally through the end of rib 13 remote from wall 40, and terminates at its inner end in an end wall 50 extending generally normal to the longitudinal axis of groove 17 and spaced a predetermined distance from the end member 41.

Similarly, the cutout or recess 46 of rib 14 opens laterally inwardly into adjacent groove 18, laterally outwardly through adjacent rib surface 32, longitudinally outwardly through the end of rib 14 remote from wall 40, and terminates at its inner end in an end wall 51 spaced a predetermined distance from the end member 42. The particular spacing or distance between end member 42 of groove 18 and the wall 51 corresponds to the height or length of a stack of dimes 25 amounting to a predetermined number or quantity, say five dollars. Thus, the end wall or surface 51 defines indicia which, when flush with the endmost dime of stack 25 predetermines the quantity of dimes in the stack. The previously described cut away end wall 50 similarly provides indicia for determining a predetermined number of nickels amounting to a quantity of two dollars.

Similarly, the rib 15, at end remote from the wall 40, is formed with a cutout or recess 47 opening laterally inwardly into groove 19, laterally outwardly through wall 34, and longitudinally through the adjacent end of the rib, while terminating at an end wall 52 extending parallel to and spaced a predetermined distance from the end member 43 corresponding to a stack of quarters amounting to ten dollars. By similar construction, the rib 16 has its cutaway or recess 48 opening laterally inwardly into groove 20, laterally outwardly through wall 36, longitudinally outwardly through the end of the rib, and terminating at its inner end in an indicia end wall 53 parallel to and spaced from the end member 44 a distance corresponding to a stack of pennies 26 amounting to 50 cents.

As the rib side walls on opposite sides of each groove are coplanar, it will be apparent that the body 11 may rest on a suitable supporting surface with any desired groove facing downwardly, and the opposite groove facing upwardly. The upwardly facing groove may receive a stack of coins extending from the groove end wall 40 to the respective indicia wall 50, 51, 52, 53.

For wrapping, it is only required to place a wrapper, as at 55, with its open end in the proper groove 17–20, say in the open end portion of the groove extending beyond the indicia wall 50–53. By the slightly oversized configuration of the receiving groove, the stacked coins may be tilted or canted, best seen in FIG. 5, for sliding gravitational movement into the receiving wrapper. With all the coins inserted in the wrapper, the open end may be closed in the conventional manner.

In addition, it will be apparent that the cut away portions 45–48 facilitate the tilting or canting action of the endmost coins of the received stack to enhance their flow into the wrapper. Also, it should be appreciated that the unused grooves facing laterally outwardly and downwardly afford convenient finger-receiving regions for grasping the device 10 and further insuring quick and easy counting and wrapping operation.

Although the present invention has been described in some detail by way of illustration and example for purposes of clarity of understanding, it is understood that certain changes and modifications may be made within the spirit of the invention.

What is claimed is:

1. A coin counter comprising an elongate body of generally polygonal cross-sectional outline for resting on a selected side and having a plurality of grooves extending longitudinally of said body for respectively receiving stacks of coins, each of said grooves being located laterally within and substantially occupying a respective side of said body, said grooves extending into said body toward each other and terminating short of each other to leave of the body material a central longitudinally extending spine and a plurality of longitudinally extending ribs outstanding from said spine toward and terminating at respective corners of said body, an end member at one end of each groove adjacent to one end of said body for abutting engagement with a stack of coins received in the respective groove, and indicia associated with each groove at a predetermined distance from the respective end member to indicate a desired quantity of coins in the respective groove, said grooves each extending beyond the associated indicia and opening through the body end opposite to said one body end for supporting a wrapper in position to engage about coins in the respective groove, and said indicia being defined by a cut formed in each rib facing generally outwardly in the same direction as the associated groove and extending chordally of the associated groove entirely through the respective rib for tactile sensing.

2. A coin counter according to claim 1, said polygonal cross-section being generally rectangular and said grooves being four in number and of different transverse dimensions for conformably receiving stacks of coins of different denominations.

3. A coin counter according to claim 1, said grooves being of generally semi-cylindrical configuration for conforming reception of a coin stack with generally semi-circular protrusion of the stack and convenient finger-gripping engagement therein by the user through the open groove end.

4. A coin counter according to claim 3, said grooves each being throughout its length of an internal radius of curvature slightly greater than the coins received to facilitate engagement over the coins in the groove of a tubular wrapper.

* * * * *